US008942402B2

(12) United States Patent
Yuasa

(10) Patent No.: US 8,942,402 B2
(45) Date of Patent: Jan. 27, 2015

(54) ACOUSTIC SPEAKER DEVICE

(75) Inventor: Akiko Yuasa, Kyoto (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 14/111,455

(22) PCT Filed: Apr. 12, 2012

(86) PCT No.: PCT/JP2012/002543

§ 371 (c)(1),
(2), (4) Date: Oct. 11, 2013

(87) PCT Pub. No.: WO2012/140895

PCT Pub. Date: Oct. 18, 2012

(65) Prior Publication Data

US 2014/0037119 A1 Feb. 6, 2014

(30) Foreign Application Priority Data

Apr. 12, 2011 (JP) ..... 2011-087882

(51) Int. Cl.
*H04R 1/28* (2006.01)
*H04R 1/02* (2006.01)

(52) U.S. Cl.
CPC ... *H04R 1/28* (2013.01); *H04R 1/02* (2013.01)
USPC ..... 381/346; 381/345; 381/337; 381/87; 381/332

(58) Field of Classification Search
USPC ..... 381/87, 152, 332–335, 345–346, 386, 381/388–389
See application file for complete search history.

(56) References Cited

U.S. PATENT DOCUMENTS

| | | | | |
|---|---|---|---|---|
| 4,657,108 | A | 4/1987 | Ward | |
| 2004/0251077 | A1 | 12/2004 | Wright et al. | |
| 2007/0165895 | A1 * | 7/2007 | Matsumura et al. | 381/351 |
| 2007/0286449 | A1 | 12/2007 | Matsumura et al. | |

FOREIGN PATENT DOCUMENTS

| | | | | |
|---|---|---|---|---|
| JP | S60-500645 | | 5/1985 | |
| JP | S63-256133 | | 10/1988 | |
| JP | H07-103389 | | 4/1995 | |
| JP | 2003-033650 | | 2/2003 | |
| JP | 2004-537938 | | 12/2004 | |
| JP | 2006-234346 | * | 9/2006 | F25D 23/06 |
| JP | 2008-079268 | | 4/2008 | |
| WO | WO 2005/101894 | | 10/2005 | |
| WO | WO 2006/022199 | | 3/2006 | |

* cited by examiner

*Primary Examiner* — Ahmad F Matar
*Assistant Examiner* — Sabrina Diaz
(74) *Attorney, Agent, or Firm* — Hamre, Schumann, Mueller & Larson, P.C.

(57) ABSTRACT

An acoustic speaker device (10) according to the present invention comprises at least two types of gas adsorption materials in a cabinet (12) thereof. A porous carbon material package member (14A), which is one of the gas adsorption materials, can adsorb or eliminate air in the cabinet (12) by a porous carbon material (41) during the operation of a speaker unit (13) so as to buffer compression or expansion of air in the cabinet (12). A sheet-like moisture adsorbing material (14B), which is the other of the gas adsorbing materials, is formed by dispersing copper ion-exchanged ZSM-5 zeolite (43) in a thermoplastic resin composition (44), and is stuck on at least a section of an inner wall of the cabinet (12). This configuration allows moisture in the cabinet (12) to be rapidly adsorbed.

6 Claims, 6 Drawing Sheets

ACOUSTIC SPEAKER DEVICE

TECHNICAL FIELD

The present invention relates to an acoustic speaker device, and particularly relates to an acoustic speaker device having enhanced ability to reproduce bass range.

BACKGROUND ART

Recently, downsizing of an acoustic device is progressed, and downsizing and/or reduction of thickness (hereinafter, referred to as "downsizing and the like") is also progressed for an acoustic speaker device. However, it is known that the reproduction of the bass range is difficult since the acoustic speaker device with the downsizing and the like has smaller volume of the cabinet.

More specifically, a general acoustic speaker device is configured to include a speaker unit incorporated in a cabinet. When electric signal is applied to the speaker unit, air in the cabinet is compressed by vibration of the speaker, which serves as an air spring to disturb the movement of the speaker. Smaller volume of the cabinet exhibits larger influence for preventing the movement of the speaker, and therefore this reduces the sound pressure level particularly in the bass region, increasing the lowest resonance frequency. Consequently, in order to enhance the ability to reproduce the bass range, it is necessary to increase the volume of the cabinet, and nevertheless, the increased volume would disturb the downsizing and the like of the acoustic speaker device.

Thus, regardless of whether the downsizing and the like is achieved, various types of technologies for improving ability to reproduce the bass range are conventionally proposed in the field of the acoustic speaker devices.

For example, an acoustic speaker device, which is configured to have a plurality of acoustic fins mounted on a wall of a cabinet in slant relation and an opening section provided at a terminal end of the acoustic fin, is disclosed in Patent Literature 1. According to this configuration, the acoustic fins form a rectangular three-dimensional spiral sound path to provide increased massive feeling in the bass range.

Also, Patent Literature 2 discloses an amplification equipment assembly, which is configured to have agglomerates of an adsorbing material such as activated carbon and the like (material agglomerates) in a cabinet (box). According to this configuration, activated carbon rapidly adsorbs or eliminates compression or expansion of the gas in the cabinet generated by vibration of the speaker unit (more specifically, diaphragm). This can suppress the pressure fluctuation within the cabinet, so that decrease in the sound quality level in the bass range can be prevented.

Also, Patent Literature 3 discloses an acoustic enclosure employing activated carbon provided in a cabinet, which is at least partially hydrophobic or is treated to be hydrophobic. When the activated carbon adsorbs water vapor, water molecules are adsorbed in pores of the activated carbon to be blocked, disturbing adsorption of air. Thus, Patent Literature 3 employs leastwise partially hydrophobic activated carbon.

Meanwhile, zeolite is known as a typical adsorbing material as well as the activated carbon, and various types of technologies for employing the zeolite by processing thereof to form film-like configuration or is sheet-like configuration are proposed.

For example, Patent Literature 4 proposes a film-like gas adsorption material, which is produced by extruding a synthetic resin containing a zeolite-based adsorbent at 1 to 50% wt. to form a film shape and then stretching the film-shaped resin. Adsorption ability for ammonia and hydrogen sulphide is evaluated in the sections of Examples in Patent Literature 4.

Also, Patent Literature 5 proposes a technology related to a vacuum insulation member employing multilayer films, in which zeolite as a getter material is kneaded in resin films constituting the multilayer films.

The multilayer film is configured to be formed by laminating polyethylene terephthalate (PET) film, aluminum foil and polyethylene (PE) film, and the vacuum insulation member is configured that the periphery of this multilayer film is thermally sealed to provide a bag shape and powder silica and the like as an aggregate is charged in the interior thereof, and the interior is vacuum-evacuated and then the opening section is sealed. Zeolite or a mixture of zeolite and activated carbon are kneaded as a getter member in the PET film and in the PE film. This allows the getter member to adsorb moisture, carbonic acid gas and the like from the outside of the multilayer film before entering into the film.

CITATION LIST

Patent Literature

Patent Literature 1: Japanese Laid-Open Patent Application Publication No. 2008-79268

Patent Literature 2: Japanese Patent Domestic Publication No. 60-500645 (1985)

Patent Literature 3: Japanese Patent Domestic Publication No. 2004-537938

Patent Literature 4: Japanese Laid-Open Patent Application Publication No. 63-256133 (1988)

Patent Literature 5: Japanese Laid-Open Patent Application Publication No. 07-103389 (1995)

SUMMARY OF INVENTION

Technical Problem

Since the technology disclosed in Patent Literature 1 requires a certain space for the installation of the acoustic fins, this technology may not be suitable for the acoustic speaker device with the downsizing and the like.

Also, while the activated carbon can provide sufficient adsorption of air in the cabinet in the dried environment in the technology disclosed in Patent Literature 2, highly humid environment causes water molecules adsorbed in pores of the activated carbon as described in Patent Literature 3 and therefore this interferes the adsorption of air in the cabinet. As a result, this cannot sufficiently correspond to the inhibition of the pressure fluctuation in the cabinet, possibly causing deterioration in the sound quality level.

In addition to above, Patent Literature 2 also discloses a diaphragm and the like for preventing moisture from entering into the agglomerate of the activated carbon (material agglomerate). However, the installation of this diaphragm causes complicated structure of the acoustic speaker device and requires a space for installing the diaphragm and the like, and thus there is a concern that this cannot sufficiently meet the requirements for the downsizing and the like.

Alternatively, a technology for introducing a drying gas in the cabinet to suppress adsorption of moisture by the activated carbon may be considered. However, this cannot provide complete hermetic seal for the dry gas in the cabinet, and thus the dry gas would be gradually substituted by the atmospheric air. Hence, while short term effect is expected by the supply of the dry gas in the inside of the cabinet, persistence of the long term effect cannot be expected.

Also, the technology disclosed in Patent Literature 3 suppresses the adsorption of moisture on the activated carbon by at least partially hydrophobizing the activated carbon. However, it is clarified according to investigations of the present inventors that such a hydrophobizing treatment cannot provide sufficient suppression for the adsorption of moisture, as described in conjunction with Reference Example that will be discussed later. Further, a hydrophobizing treatment with a silicon containing compound disclosed in Patent Literature 3, which is employed in general hydrophobizing treatment, is a relatively expensive treatment, and thus is not preferable in view of the process cost.

Further as will be discussed later, it is also clarified according to investigations of the present inventors that it is critical to reduce partial pressure of water vapor (equilibrium water vapor pressure) in the cabinet to a level equal to or lower than 1,000 Pa, when the ability to reproduce the bass range in the acoustic speaker device is improved by providing the activated carbon in the cabinet. Hence, for example, it is considered that a zeolite-based adsorbing material is used together in the cabinet for preventing moisture from being adsorbed by the activated carbon.

However, since larger volume of moisture cannot be sufficiently adsorbed by employing film-like or sheet-like gas adsorption material disclosed in Patent Literature 4 or 5, it is difficult to adsorb moisture to obtain the equilibrium water vapor pressure in the cabinet of equal to or less than 1,000 Pa. For example, the gas adsorption material disclosed in Patent Literature 4 adopts hydrogen sulphide and ammonia as principal objects for adsorption, and there is no description on the adsorption of moisture. Also, while there is a description on the adsorption of moisture as well as that of carbonic acid gas in relation to the gas adsorption material disclosed in Patent Literature 5, the gas adsorption material adopts the adsorption of moisture to be entered in the multilayer film and does not adopts the adsorption over larger space as the entire space of the cabinet, and therefore the gas adsorption material cannot adsorb larger volume of moisture.

Further, while a technology for, for example, introducing metallic ion in zeolite via ion-exchanging or the like is known in order to enhance the adsorption capacity of the gas by increasing the activity of zeolite, such an activation technology may not be adopted for the gas adsorption material disclosed in Patent Literature 4 or 5 according to investigations of the present inventors.

More specifically, the film-like or sheet-like gas adsorption material is generally produced by blending and mixing a predetermined amount of zeolite (and additives) in a thermoplastic resin and thermally forming thereof. When metallic ion is introduced to zeolite at this time, metallic ion acts as a catalyst according to, for example, the conditions or the like in the thermal forming, and thus the thermoplastic resin may be corroded (copper corrosion). For example, while Examples employing polypropylene as thermoplastic resin are described in Patent Literature 4, the thermally forming temperature is 230 degrees C. to 250 degrees C. in this case, and thus there is a possibility to cause sufficient catalytic action by metallic ion.

If suitable range for the thermally forming temperature is not defined for the specific type of the thermoplastic resin as described above, the forming into the film-like shape or the sheet-like shape could not be achieved, or even if the forming thereof would be achieved, there would be a concern for causing a tear, a crack, or a discoloration and the like. Such a gas adsorption material involves considerably deteriorated handling-ability.

Primarily, Patent Literature 4 or 5 contains no description on specific class (type) of zeolite, or introduction of metallic ion into zeolite or the like, and therefore there is primarily no consideration on the increase of the activity of zeolite. Hence, even if the gas adsorption material disclosed in Patent Literature 4 or 5 is adopted in the acoustic speaker device, it is not sufficient to achieve sufficient adsorption of moisture in the cabinet.

The present invention is made in order to solve such a problem, and it is an object of the present invention to provide an acoustic speaker device, which is configured to achieve enhanced ability for reproducing the bass range and to be adapted to the downsizing and/or the reduction of thickness.

Solution to Problem

An acoustic speaker device according to the present invention is configured, in order to solve the above-described problems, to comprise: a cabinet; a speaker unit mounted on the cabinet; and a gas adsorption material provided in the inside of the cabinet and being capable of adsorbing moisture and a gas component in the cabinet; wherein the gas adsorption material is composed of at least a porous carbon material and a sheet-like moisture adsorbing material, and wherein the sheet-like moisture adsorbing material is formed by dispersing copper ion-exchanged ZSM-5 zeolite in a base material composed of at least a polymer material, and is stuck on at least a section of an inner wall of the cabinet.

The acoustic speaker device of the aforementioned configuration may be configured that the aforementioned sheet-like moisture adsorbing material is stuck on at least the inner surface of the aforementioned cabinet corresponding to the front side thereof.

The acoustic speaker device of the aforementioned configuration may also be configured that the aforementioned sheet-like moisture adsorbing material is stuck on at least a section of the inner surfaces of the aforementioned cabinet right under the aforementioned porous carbon material.

The acoustic speaker device of the aforementioned configuration may also be configured that the aforementioned base material of the aforementioned sheet-like moisture adsorbing material is a resin composition containing a thermoplastic resin as the aforementioned polymer material.

The acoustic speaker device of the aforementioned configuration may also be configured that the aforementioned sheet-like moisture adsorbing material is formed by blending equal to or lower than 40 parts by weight of the aforementioned ZSM-5 zeolite in 100 parts by weight of the aforementioned resin composition and then thermally forming the blended material into a sheet form.

The acoustic speaker device of the aforementioned configuration may also be configured that the aforementioned sheet-like moisture adsorbing material is thermally formed at a temperature equal to or lower than an upper limit temperature, which is higher by 60 degrees C. than a softening temperature of the aforementioned thermoplastic resin.

The above and other objects, features and advantages of the present invention will become more apparent from the following description when taken in conjunction with the accompanying drawings.

Advantageous Effects of Invention

In the present invention, advantageous effects for providing an acoustic speaker device, which is configured to achieve enhanced ability for reproducing the bass range and to be adapted to the downsizing and/or the reduction of thickness, can be achieved.

DESCRIPTION OF EMBODIMENTS

Figure 1:
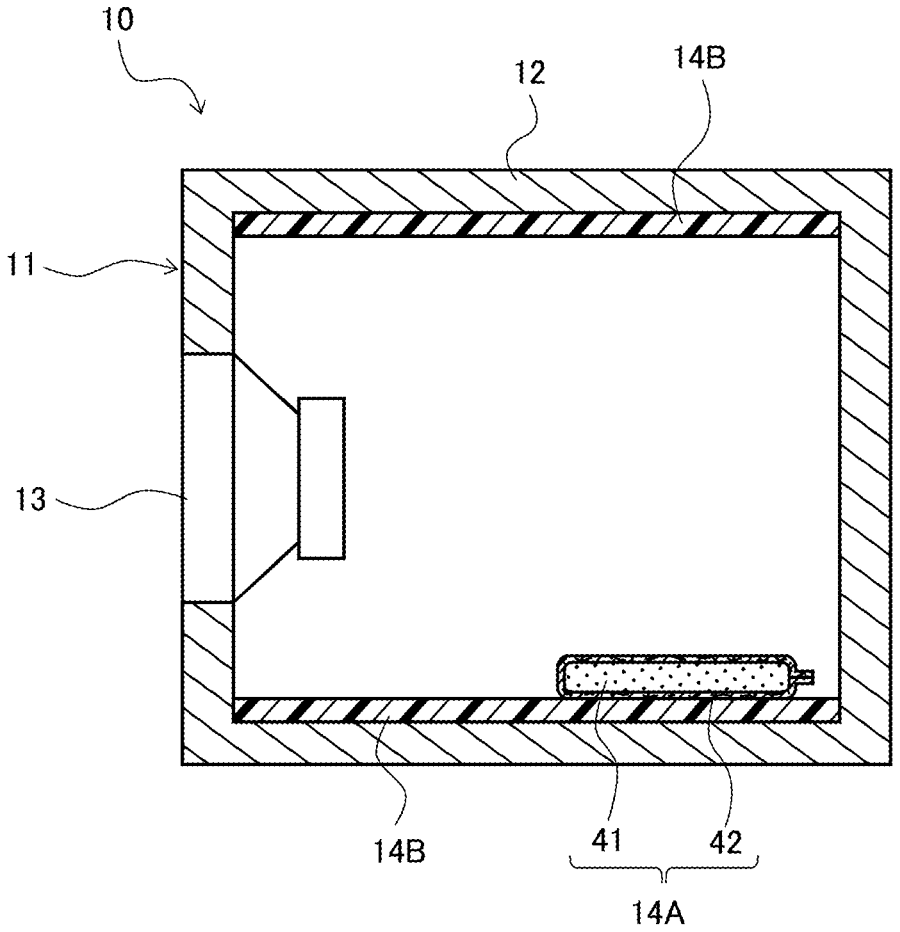
FIG. 1 is a schematic cross-sectional view, showing a schematic configuration of an acoustic speaker device according to an embodiment of the present invention.

Hereinafter, preferable Embodiments of the present invention will be described in reference to the annexed figures. Hereinafter, same reference numeral is assigned to same or corresponding element in all diagrams, and the duplicated description is not given. Also, it is not intended to limit the present invention by the present embodiment.

[Configuration of Acoustic Speaker Device]

First of all, an example of a configuration of an acoustic speaker device according to the present embodiment will be specifically described in reference to FIG. 1. As shown in FIG. 1, an acoustic speaker device 10 is a closed type speaker device, which includes a cabinet 12, a speaker unit 13, a porous carbon material package unit 14A, and a sheet-like moisture adsorbing material 14B.

The cabinet 12 (or enclosure, acoustic box or the like) is configured that the speaker unit 13 is mounted on a front face 11 thereof and the interior thereof is substantially tightly closed. Specific shape material, dimension and the like of the cabinet 12 are not particularly limited, and known shape and material are suitably selected depending on the application, and suitable dimension is defined depending on the application.

The speaker unit 13 is mounted on the front face 11 of the cabinet 12, and the front side thereof is positioned in the outside of the cabinet 12 and the rear side faces the interior space of the cabinet 12. In the present embodiment, a cone type speaker is employed for the speaker unit 13. In addition to above, the specific configuration of the speaker unit 13 is not particularly limited to any specific type, and known type such as dome type, horn type, ribbon type and the like may be preferably employed according to various conditions such as application, shape, dimension and the like.

A porous carbon material package unit 14A and a sheet-like moisture adsorbing material 14B are provided in the interior of the cabinet 12. These are provided within the cabinet 12, and are employed as gas adsorption materials, which are capable of adsorbing moisture and a gas component in the cabinet 12.

The porous carbon material package unit 14A serves as rapidly adsorbing or eliminating compression or expansion of the gas in the cabinet 12 generates by the speaker unit 13, and in other words, is a gas adsorption material, which is capable of adsorbing or eliminating air so as to buffer the compression or the expansion of air in the cabinet 12. The porous carbon material package unit 14A is composed of a porous carbon material 41 and a bag member 42 as will be discussed later, and is placed on a floor surface (inner surface in the lower side) in the cabinet 12 without being fixed.

The sheet-like moisture adsorbing material 14B serves as depressing or avoiding the adsorption of moisture by the porous carbon material package unit 14A by adsorbing as much moisture in the cabinet 12 as possible, and in other words, is a gas adsorption material, which is capable of adsorbing moisture in the cabinet 12 more preferentially as compared to the porous carbon material package unit 14A.

Figure 2:
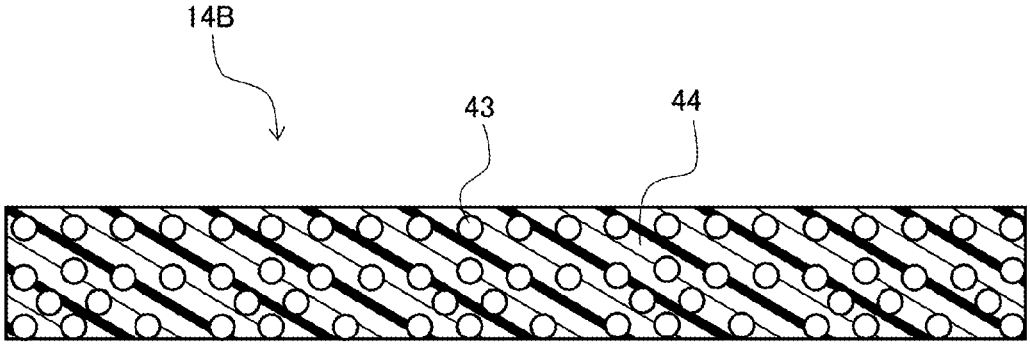
FIG. 2 is a schematic cross-sectional view, showing an example of a configuration of a sheet-like moisture adsorbing material included in the acoustic speaker device shown in FIG. 1.

In the description in reference to FIG. 2, the sheet-like moisture adsorbing material 14B is configured as a resin sheet, in which copper ion-exchanged ZSM-5 zeolite 43 (hereinafter abbreviated as "Cu-ZSM-5 zeolite 43", for the purpose of the convenience in the description) is dispersed in a resin composition 44 containing a thermoplastic resin (thermoplastic resin composition 44), and is stuck on each of a floor surface and a ceiling surface (upper-side inner surface) among inner surfaces of the cabinet 12 in the present embodiment. In addition to above, the details of the Cu-ZSM-5 zeolite 43 and the thermoplastic resin composition 44 will be described later.

The speaker unit 13 is applied with an electric signal to generate pressure in a voice coil such that a cone-shaped diaphragm vibrates. This allows the device to emit sound from the front side and the rear side of the diaphragm. Since the sound from the front side and the sound from the rear side are mutually in the antiphase relation, the sound emitted from the rear side is shielded by covering the rear side of the speaker unit 13 with the cabinet 12, which serves as a sealed housing.

Meanwhile, the sound pressure generated in the rear side of the diaphragm increases the internal pressure in the cabinet 12. This allows the inside of the cabinet 12 to function as an air spring to obstruct the action of the speaker unit 13 (movement of the diaphragm). Since this obstruction is more significant as the volume of the cabinet 12 is small, the effect of the air spring can be moderated by the porous carbon material package unit 14A to effectively suppress the deterioration of the ability to reproduce the bass range.

[Porous Carbon Material Package Unit]

In the next, the porous carbon material package unit 14A will be described. The bag member 42 of the porous carbon material package unit 14A is composed of a nonwoven fabric having permeability, four sides of which are sealed to form a bags shape configuration. The porous carbon material 41 is encapsulated in the interior of this bag member 42.

The porous carbon material 41 is a material containing carbon as the major constituent and having a large number of fine holes (pore) on the surface (porous material), and the specific configuration thereof is not particularly limited. Various types of activated carbons, porous carbon black, carbon nanotube, porous carbon ceramics and the like are exemplified as typical examples. Among these, activated carbon is particularly preferably employed in view of the gas adsorbability in the cabinet 12 and the cost.

Typical examples of the specific activated carbons include: plant raw material-based activated carbons such as sawdust carbon, coconut shell carbon, wood charcoal and the like; mineral raw material-based activated carbons such as coal (lignite, brown coal, bituminous coal, anthracite coal and the like), grass peat (peat), oil carbon, coal pitch, petroleum pitch and the like; synthetic resin-based activated carbons such as phenolic-based activated carbon, rayon-based activated carbon, acrylonitrile-based activated carbon and the like. One of these activated carbon materials may be employed alone, or a suitable combination of two or more of these may alternatively be employed.

Also, the form of the porous carbon material 41 is not particularly limited, and known forms such as powder form, granular form (pelletized form), fiber form, honeycomb form, cake form and the like may be preferably employed. In case of the granular form, the shape of the grain (pellet) typically includes crushed-shape, cylindrical-shape, spherical-shape and the like. If the porous carbon material 41 is in the powder form or the granular form, it is preferable to employ by encapsulating them in a package member such as the bag member 42 and the like, and on the other hand, if it is in the fiber form or the cake form, it is not necessary to encapsulate them in a package member. In view of the gas adsorbability, it is preferable to be in the powder form or in the granular form.

While the bag member 42 is composed of a nonwoven fabric as described above, specific fiber material employed for the nonwoven fabric is not particularly limited, and this may be formed of a known fiber material such as nylon fibers, vinylon fibers, polyester fibers, polyolefin fibers, rayon fibers, cellulose fibers and the like. Also, the type of the configuration of sealing the four sides is not particularly limited, and in case of the fiber composed a thermoplastic resin such as polyolefin fiber or the like, the nonwoven fabric may be directly heated to provide the seal, or a hot melt-type adhesive agent may be employed, or known seal member may be employed.

Alternatively, if the external leakage of the porous carbon material 41 enclosed in the inside can be avoided, the bag member 42 may be composed of a woven fabric. The fiber material employed in this occasion may be the above-described known material. Alternatively, if better permeability sufficient for achieving the gas adsorption is assured, the bag member 42 may be composed of a permeable sheet member, instead of fabrics such as nonwoven fabric, woven fabric and the like.

[Copper Ion-Exchanged ZSM-5 Zeolite]

In the next, an example of a configuration of Cu-ZSM-5 zeolite 43 employed for the sheet-like moisture adsorbing material 14B will be specifically described.

The Cu-ZSM-5 zeolite 43 may be prepared by passing through the processes of ion-exchanging the zeolite having ZSM-5 skeleton (ZSM-5 zeolite) with copper (copper ion exchanging step), and rinsing with water (rinsing step), and then drying the zeolite (drying step). In addition to above, other process except copper ion-exchanging rinsing with water and drying may be conducted as required.

The specific configuration of the employed ZSM-5 zeolite is not particularly limited, and a commercially available powder form product may be preferably employed. Also, the particle diameter of the ZSM-5 zeolite is not particularly limited, and it is sufficient if the particle diameter is in the range that can cause sufficient dispersion in the thermoplastic resin composition 44 and improved formation into the sheet-form (or film-form), as will be discussed later. An example of the preferable particle diameter may be within the range of 0.1 to 10 μm, and it is needless to point out that the diameter is not limited to this range.

The copper ion-exchanging step may be conducted by a known method. More specifically, for example, a method for dipping the ZSM-5 zeolite in an aqueous solution of soluble salt of copper is generally employed. Typical soluble salt of copper employed in this occasion includes, for example: inorganic salts such as copper chloride, copper nitrate, copper sulfate and the like; or organic salts such as copper acetate, copper propionate and the like. Among these, the zeolite, which is copper ion-exchanged with an aqueous solution containing carboxylate of divalent copper ion ($Cu2^{+}$) such as copper (II) propionate or copper (II) acetate and the like, exhibits tendency of providing increased moisture adsorption activity, and thus is preferable.

A rinsing step is a process step for sufficiently rinsing the ZSM-5 zeolite with water after the copper ion-exchanging step. Specific conditions for the water rinsing is not particularly limited, and for example, it is sufficient to employ high-purity water such as ion-exchange water and the like, and the time for the water rinsing may be determined so as to sufficiently remove the soluble salt or the like.

The drying step is a process step for removing moisture adhered to the surfaces of the ZSM-5 zeolite. Specific means for the drying is not particularly limited, and general thermal drying or drying at reduced pressure may be employed, and the drying temperature and the drying time may be determined to be temperature and time so as to sufficiently remove moisture.

The Cu-ZSM-5 zeolite 43 thus prepared exhibits activity with enhanced moisture adsorption within the low partial pressure region. More specifically, it is known about the zeolite that the diameter of the pore can be controlled by suitably selecting the type of ion. And, the Cu-ZSM-5 zeolite 43 has the ZSM-5 skeleton and contains introduced copper ion, so that the pores formed on the surfaces thereof have the diameter and the shape that are suitable for the adsorption of moisture. In addition, as described above, after the copper ion-exchanging step, the water rinsing step and the drying step are passed through, the introduced copper ion is activated by the thermal treatment. This allows the Cu-ZSM-5 zeolite 43 to have the pores that are desirable for the physical adsorption and exhibiting improved chemical adsorption with activated copper ion, and in particular, it is possible to exhibit enhanced moisture adsorption activity in the low partial pressure region according to a behavior that is similar to the chemical adsorption.

Also, while the prepared Cu-ZSM-5 zeolite 43 may be employed for the production of the sheet-like moisture adsorbing material 14B (sheet forming) as they are, various types of post treatment or post processing may be conducted as required. More specifically, for example, a thermal drying treatment, a vacuum thermal treatment a granulation processing, or a surface modifying treatment and the like may be exemplified.

The thermal drying treatment may be conducted in order to eliminate (remove) moisture adsorbed by the Cu-ZSM-5 zeolite 43. This is because there may be a concern that the Cu-ZSM-5 zeolite 43 adsorbs the moisture in the air while the zeolite is stored after the preparation and before the use for the sheet forming. This allows the Cu-ZSM-5 zeolite 43 to be employed for the sheet forming in the condition that the contained moisture is eliminated, so that the moisture adsorption capacity of the obtained sheet-like moisture adsorbing material 14B can be relatively increased.

While the conditions of the thermal drying treatment for the Cu-ZSM-5 zeolite 43 is not particularly limited, a typical condition is to heat at a temperature within a range from about 100 degrees C. to 300 degrees C. by employing a known drying furnace for, for example, about several hours, which achieves elimination of about 90 to 95% of moisture absorbed during the storage.

The vacuum thermal treatment may be conducted for eliminating moisture from the Cu-ZSM-5 zeolite 43 and activating the introduced copper ion. the activation of copper ion by the vacuum thermal treatment means that divalent copper ion ($Cu2^{+}$) is reduced to monovalent copper ion (Cu) to exhibit higher moisture adsorption activity. Consequently, in order to provide further enhanced moisture adsorbing ability of the obtained sheet-like moisture adsorbing material 14B, it is preferable to conduct the vacuum thermal treatment.

While the conditions of the vacuum thermal treatment for the Cu-ZSM-5 zeolite 43 is not particularly limited, a typical condition may be exemplified that the pressure is equal to or lower than 10 Pa, preferably equal to or lower than 1 mPa, and the heating temperature is equal to or higher than 300 degrees C., preferably within a range from about 500 to 600 degrees C. Concerning the temperature, while it is necessary to basically define to be equal to or higher than 300 degrees C. for the purpose of more appropriately proceeding the reduction of copper ion, it may alternatively be equal to or lower than 300 degrees C., depending on the conditions.

Concerning the granulation processing, a known method may be employed to aggregate the powder-form Cu-ZSM-5 zeolite 43 to process them into the granular form. Also, the surface modifying treatment may be conducted by, for example, conducting a known modifying treatment over the surface of the Cu-ZSM-5 zeolite 43 so as to cause no obstruction for the moisture adsorption, in order to achieve improved dispersibility in the thermoplastic resin composition 44.

[Sheet-Like Moisture Adsorbing Material and Thermoplastic Resin Composition]

Next, an example of a configuration of the thermoplastic resin composition 44 employed for the sheet-like moisture adsorbing material 14B, an example of a configuration of the sheet-like moisture adsorbing material 14B, and an example of the method for forming the sheet-like moisture adsorbing material 14B will be specifically described.

The thermoplastic resin composition 44 is a base material of the sheet-like moisture adsorbing material 14B, and is a composition containing a thermoplastic resin as the major constituent, and further containing various types of additives as required.

Specific type of the thermoplastic resin serving as the major constituent is not particularly limited, and typically includes, for example: polyolefin resins such as low density polyethylene, high density polyethylene, linear low density polyethylene, polypropylene and the like; polyester resins (including aliphatic, in addition to aromatic) such as polyethylene terephthalate, polybutylene terephthalate, polyethylenenaphthalate, polybutylene naphthalate and the like; polyamide resins such as nylons, aramid and the like; polyacetal resins; other types of aromatic type resins such as polyarylate resins polysulfone resins, polycarbonate resins, polyethersulfone resins polyetheretherketone resins and the like; polyphenylene-based resins such as polyphenylene ether resins, polyphenylene sulfide resins Polyphenylene oxide resin, and the like; polyimide-based resins such as polyimide resins, polyetherimide resins, polyamideimide resins and the like; acrylonitrile butadiene styrene (ABS)-based resins such as acrylonitrile butadiene styrene (ABS) resins, a-methylstyrene-based ABS resins, phenylmaleimide-based ABS resins, acrylonitrile styrene acrylate (ASA) resins, acrylonitrile ethylene styrene (AES) resins and the like; acrylonitrile stylene (AS) resins (stylene acrylonitrille (SAN) copolymer); and cellulose-based resins such as cellulose acetate, cellulose acetate butyrate and the like.

One of these thermoplastic resins may be employed alone, or a mixture of two or more of these may be employed.

The thermoplastic resin composition 44 may contain, in addition to the above-described one or more of the thermoplastic resins, various types of additives such as a dispersant, an antioxidant, an antistat, a fire retardant agent, plasticizer and the like, and/or may contain a gas adsorbent except the Cu-ZSM-5 zeolite 43, a filler as a loaded material and the like. Consequently, in the present embodiment, it can be defined that the thermoplastic resin composition 44 is the components except the Cu-ZSM-5 zeolite 43, which is regarded as a composition containing a thermoplastic resin as the major constituent.

Here, a typical additive may include a dispersant for enhancing the dispersibility of the Cu-ZSM-5 zeolite 43 when the thermoplastic resin and the Cu-ZSM-5 zeolite 43 are mixed. More specifically, for example, a lubricant such as paraffin and the like may be employed for this dispersant, and the available dispersant is not limited thereto, and suitable compound may be selected from known compounds depending on the type of the thermoplastic resin.

While the blending quantity of the Cu-ZSM-5 zeolite 43 over the thermoplastic resin composition 44 is not particularly limited, the blending is preferably carried out so that Cu-ZSM-5 zeolite 43 is contained at 40 parts by weight over 100 parts by weight of the thermoplastic resin composition 44. If the blending quantity of Cu-ZSM-5 zeolite 43 is equal to or lower than 40, no copper corrosion is occurred in the obtained sheet-like moisture adsorbing material 14B regardless of the various conditions (type of thermoplastic resin, types of additives, dimension of sheet, forming condition and the like), so that generation of crack or cleavage can be effectively suppressed. Hence, improved strength and improved handling ability can be achieved for the obtained sheet-like moisture adsorbing material 14B. In addition to above, if the blending quantity of the Cu-ZSM-5 zeolite 43 is larger than 40 parts by weight, a crack or a cleavage may be generated to deteriorate the appearance or the handling ability may be deteriorated, depending on the various conditions.

Concerning dimensions of the sheet-like moisture adsorbing material 14B such as the width or length or the like, suitable dimension may be defined in accordance with the size and the like of the cabinet 12 employed in the acoustic speaker device 10. Also, the thickness of the sheet-like moisture adsorbing material 14B is not particularly limited, and it is sufficient to have a certain thickness, which can provide certain flexibility such that this can be recognized as the sheet-form, depending on the type of the thermoplastic resin or the type of the additives. Generally, it is sufficient to have the thickness within the range of equal to or larger than about 1 μm and equal to or smaller than 1 mm (1,000 μm), and further, it is preferable to reduce the thickness to the range of 1 to 10 μm.

The method of forming the sheet-like moisture adsorbing material 14B according to the present embodiment is not particularly limited, and as described above, the Cu-ZSM-5 zeolite 43 may be blended to achieve blending quantity of equal to or lower than 40 parts by weight over 100 parts by weight of the thermoplastic resin composition 44, and then the thermal forming may be carried out into the sheet-like product.

More specifically, for example, first of all, predetermined quantities of raw material pellets of one or more of the thermoplastic resins, additives such as dispersant (for example, paraffin) and the like, and the Cu-ZSM-5 zeolite 43 are prepared respectively, and these are supplied in a supply device such as a hopper or the like, and then are mixed. The obtained mixture is supplied to a forming machine, in which the sheet forming is conducted while the mixture is heated. The type of the forming machine is not particularly limited as long as the machine is capable of carry out the sheet forming, and typically, a known extruder or a known film cast machine and the like may be employed.

Meanwhile, in the present embodiment, it is preferable to preliminarily define the upper limit temperature in thermal forming. This upper limit temperature is set as a temperature 60 degrees C. higher than the softening temperature (melting point) of the employed thermoplastic resin. For example, when the thermoplastic resin is high density polyethylene (HDPE), the softening temperature thereof is 130 degrees C., and thus the upper limit temperature in the sheet forming step is defined as equal to or lower than 190 degrees C. Such an upper limit temperature is defined to achieve that the sheet-like moisture adsorbing material 14B having reduced thickness can be easily formed and no copper corrosion is occurred in the obtained sheet-like moisture adsorbing material 14B to achieve almost no generation of a crack or a cleavage, such that sufficient strength and improved handling ability can be ensured.

Meanwhile, the softening temperature is varied even in the same type of the thermoplastic resins depending upon the polymerization degree and the like, and for example, in the case of polyethylene, the softening temperature is not necessarily 130 degrees C., and is generally within the range of 100 to 140 degrees C. Hence, the upper limit temperature may be defined on the basis of the softening temperature of the employed thermoplastic resin as the reference so as to be equal to or lower than a temperature that is 60 degrees C. higher than the softening temperature. Also, when two or more of the thermoplastic resins are employed, the upper limit temperature may be defined on the basis of the softening temperature in the condition of the polymer alloy or the polymer blend as the reference, or the upper limit temperature may be defined on the basis of the softening temperature of either one of the thermoplastic resins as the reference.

[Arrangement of Gas Adsorption Material and Gas Adsorption Effect]

Next, arrangements of the porous carbon material package unit 14A serving as the gas adsorption material and the sheet-like moisture adsorbing material 14B in the cabinet 12 and gas adsorption effects thereof will be specifically described.

While it is sufficient to dispose the porous carbon material package unit 14A and the sheet-like moisture adsorbing material 14B within the cabinet 12, the sheet-like moisture adsorbing material 14B is stuck on the inner surface of the cabinet 12. This allows the volume required for installing the sheet-like moisture adsorbing material 14B to be considerably reduced, so that substantial increase in the volume of the interior of the cabinet 12 can be avoided. Thus, increase in the size of the acoustic speaker device 10 can be avoided, and even if acoustic speaker device 10 is smaller-sized, the sheet-like moisture adsorbing material 14B can be mounted thereon without disturbing the reduction in the size.

Also, concerning the adsorbing activity of the sheet-like moisture adsorbing material 14B according to the present embodiment, the activity for adsorbing moisture is higher than the activity for adsorbing nitrogen which is the major constituent of the atmospheric air or oxygen and the like. Thus, even if the sheet-like moisture adsorbing material 14B is in contact with the atmospheric air to adsorb nitrogen or oxygen and the like in advance, the adsorbing material preferentially adsorb moisture when moisture is present in the cabinet 12. This can cause substitution of nitrogen or oxygen with water, so that the moisture in the cabinet 12 can be rapidly adsorbed.

Hence, the sheet-like moisture adsorbing material 14B preferentially adsorbs moisture to effectively inhibit a concern for causing a situation where the porous carbon material package unit 14A adsorbs moisture to reach saturated condition. Thus, the porous carbon material package unit 14A can adsorb or eliminate air in the cabinet 12 in the operation of the speaker unit 13 so as to buffer compression or expansion of air in the cabinet 12. This results in sufficiently exhibiting ability to reproduce the bass range in the acoustic speaker device 10.

Meanwhile, adsorption-start water vapor pressure of the sheet-like moisture adsorbing material 14B is preferably equal to or higher than a pressure of equal to or lower than 50 Pa. The adsorption-start water vapor pressure employed here represents an equilibrium pressure corresponding to the measured absorbed amount of generally equal or higher than 0.1 ml/g in the moisture adsorption isotherm measured by adsorption capacity method at the condition of 25 degrees C.

The general adsorption-start water vapor pressure of the porous carbon material 41 is within the range of 80 to 500 Pa. Also, the adsorption-start water vapor pressure when the adsorption of larger quantity of moisture is started, or the adsorption-start water vapor pressure when the rapid adsorption is started is within the range of 1,200 to 2,000 Pa. Thus, a material having the adsorption-start water vapor pressure that is sufficiently lower than the porous carbon material 41 may be employed as the sheet-like moisture adsorbing material 14B to achieve substantially completely suppressing the moisture adsorption of the porous carbon material 41. If the adsorption-start water vapor pressure of the sheet-like moisture adsorbing material 14B is lower than a pressure of equal to or higher than 80 Pa, it may possibly insufficiently suppress the moisture adsorption of the porous carbon material 41.

Here, the inner surface of the cabinet 12 indicates a surface of a wall in the inside of the cabinet 12, and the inner surface, on which the sheet-like moisture adsorbing material 14B is stuck, is preferably a surface that does not substantially obstruct the installation of various types of members constituting the acoustic speaker device 10. In the present embodiment, as shown in FIG. 1, the sheet-like moisture adsorbing materials 14B are stuck on a floor surface and a ceiling surface. Also, a method for sticking the sheet-like moisture adsorbing material 14B is not particularly limited, and known physical fixing members such as known various types of adhesive agents, known two-sided tapes and the like may be utilized.

Meanwhile, the specific position, on which the sheet-like moisture adsorbing material 14B is stuck, is not limited to the floor surface and the ceiling surface, it is preferable to be the position which satisfies at least one of following two conditions.

First of all, the first condition is that the sheet-like moisture adsorbing material 14B is preferably stuck at least on an inner surface that corresponds to the front side of the cabinet 12. This first condition is provided by considering a penetration of moisture from the outside of the cabinet 12.

If the acoustic speaker device 10 is configured to close the rear side thereof as the closed type speaker as shown in FIG. 1, instead of the configuration of opening the rear side, the only possible entrance for moisture entering from the outside of the cabinet 12 is substantially the front face 11 that the speaker unit 13 is provided. Thus, the sheet-like moisture adsorbing material 14B is stuck on the front side to preferentially adsorb moisture entering from the outside. This can decrease a possibility, in which the porous carbon material package unit 14A (to be exact, encapsulated porous carbon material 41) adsorbs the moisture.

Next, the second condition is that the sheet-like moisture adsorbing material 14B is preferably stuck on at least a section of the inner surfaces of the cabinet 12 right under the porous carbon material package unit 14A. This second condition is provided by considering the position of the porous carbon material package unit 14A in the cabinet 12.

As described above, the sheet-like moisture adsorbing material 14B is provided in order to preferentially adsorb moisture, so as to prevent the porous carbon material package unit 14A from adsorbing moisture. In order to stably dispose the porous carbon material package unit 14A in the cabinet 12 by a simple technique, it is sufficient to place the member on the floor surface in the manner as indicated in the present embodiment. Thus, the sheet-like moisture adsorbing material 14B is stuck on a section right under the porous carbon material package unit 14A to allow that the moisture in the cabinet 12 can be preferentially adsorbed on the sheet-like moisture adsorbing material 14B before causing the adsorption by the porous carbon material package unit 14A.

The sheet-like moisture adsorbing materials 14B is stuck wholly over the floor surface and the ceiling surface in the cabinet 12 as described above in the present embodiment, and therefore this achieves that the sheet-like moisture adsorbing material 14B is stuck so as to satisfy the first condition. Also, as shown in FIG. 1, the porous carbon material package unit 14A is placed over the floor surface in the cabinet 12, and the floor surface of the cabinet 12 is stuck with the sheet-like moisture adsorbing material 14B. Hence, this achieves that the sheet-like moisture adsorbing material 14B is stuck so as to satisfy the second condition.

While the porous carbon material package unit 14A is merely placed on the floor surface in this configuration, this may alternatively be fixed on the floor surface by a known technique, or may be fixed on a location except the floor surface. In such cases, it is sufficient that the sheet-like moisture adsorbing material 14B is stuck on an appropriate inner surface in the cabinet 12 so as to satisfy the above-described first condition and/or second condition.

As described above, the acoustic speaker device 10 according to the present embodiment comprises the porous carbon material package unit 14A serving as the gas adsorption material, which is capable of preferentially adsorbing and eliminating air, and the sheet-like moisture adsorbing material 14B including the Cu-ZSM-5 zeolite 43 and the thermoplastic resin composition 44 in the cabinet 12, on which the speaker unit 13 is mounted. In addition, from the results of Reference Example as described later, the partial pressure of moisture in the atmospheric air (equilibrium water vapor pressure) is approximately on the order of 1,000 Pa, in the general operating environment of the acoustic speaker device 10.

According to the aforementioned configuration, the sheet-like moisture adsorbing material 14B can exhibit higher adsorbing activity for moisture even in highly humid environment, in which partial pressure of water in the atmospheric air is beyond 1,000 Pa, and therefore can rapidly adsorb and remove moisture in the cabinet 12. Hence, the inside of the cabinet 12 can be maintained at an equilibrium water vapor pressure of lower than 1,000 Pa, so that saturation of the porous carbon material 41 encapsulated in the porous carbon material package unit 14A with water by adsorbing moisture can be effectively inhibited.

This allows the porous carbon material package unit 14A to adsorb or eliminate air in the cabinet 12 during the operation of the speaker unit 13 so as to buffer compression or expansion of air in the cabinet 12. This results in effectively suppressing fluctuation in the pressure within the cabinet 12, so that sufficient ability to reproduce the bass range in the acoustic speaker device 10 is obtained. Hence, for example, substantially equivalent level of the sound effect as obtained by employing a cabinet 12 having larger volume can be obtained without increasing the volume of the cabinet 12.

In addition, according to the present embodiment, there is no need to carry out expensive hydrophobizing treatment over the porous carbon material 41 or to introduce a dry gas in the inside of the cabinet 12, unlikely as in the conventional technology, and thus the production of the acoustic speaker device 10 with enhanced quality can be achieved with simple production process.

Further, since the moisture adsorbing material is in the sheet form, this can be stuck on the inner surface of the cabinet 12. Hence, the shape of the interior space of the cabinet 12 can be substantially maintained without deteriorating the appearance or the like of the inside thereof. In addition, the volume required for installing the sheet-like moisture adsorbing material 14B can be reduced, so that the volume in the inside of the cabinet 12 is not substantially reduced. Hence, increase in the size of the acoustic speaker device 10 can be suppressed, and this can preferably be employed in the small-sized acoustic speaker device 10.

Modified Embodiment

While the acoustic speaker device 10 according to the present embodiment is the closed-type device as shown in FIG. 1, the present embodiment is not limited thereto, and is also applicable to be utilized in any type of acoustic speaker devices, if the acoustic speaker device has room for improvement in the ability to reproduce the bass range. More specifically, for example, this may be also applicable to a bass reflex type device.

If the acoustic speaker device 10 is a bass reflex type device, a duct connected from the front face 11 to the inside of the cabinet 12 is provided, and in such a case, the sheet-like moisture adsorbing material 14B may be stuck on at least an interior of the duct or stuck near the opening of the duct in the cabinet 12. This allows the sheet-like moisture adsorbing material 14B to adsorb the moisture more preferentially than the porous carbon material 41, so that the porous carbon material package unit 14A can adsorb or eliminate air in the cabinet 12 during the operation of the speaker unit 13 so as to buffer compression or expansion of air in the cabinet 12.

Also, while the sheet-like moisture adsorbing material 14B is configured to employ the thermoplastic resin composition 44 as the base material in the present embodiment, the present embodiment is not limited thereto, and it is sufficient that the base material is composed of at least a polymer material and the Cu-ZSM-5 zeolite 43 is dispersed in this base material. Typical polymer material serving as the base material may be, for example, a thermosetting resin composition, or a resin composition that is capable of being cured by a non-thermal chemical reaction, or may be a resin composition, which is not necessarily cured, but is capable of retaining sheet-form or film-form in the condition that the Cu-ZSM-5 zeolite 43 is dispersed therein.

In addition, while the present embodiment is configured that the sheet-like moisture adsorbing material 14B is stuck on the floor surface and the ceiling surface and that the present embodiment preferably satisfies the above-described first condition (condition for being stuck on at least the inner surface that corresponds to the front side of the cabinet 12) or the above-described second condition (condition for being stuck on at least a section of the inner surfaces of the cabinet 12 right under the porous carbon material package unit 14A), or both of these conditions, the present embodiment is not limited thereto, and the sheet-like moisture adsorbing material 14B may be stuck on the whole inner surface of the cabinet 12, or may be stuck so as not to satisfy the above-described respective conditions.

Further, an acoustic speaker device having the following respective configurations may be included in a modified embodiment of the present embodiment.

More specifically, an acoustic speaker device according to the present embodiment may alternatively comprise at least: a cabinet; a speaker unit mounted on the aforementioned cabinet; and a gas adsorption material for speaker device provided in the aforementioned cabinet, wherein the aforementioned gas adsorption material for the speaker device comprises at least a porous carbon material and a sheet-like moisture adsorbent, and wherein the aforementioned sheet-like moisture adsorbent contains at least a copper ion-exchanged ZSM-5 zeolite (Cu-ZSM-5 zeolite) and a thermoplastic resin component.

This allows the moisture in the cabinet to be rapidly adsorbed and removed by the sheet-like moisture adsorbent exhibiting higher adsorbing activity for water even in an environment, in which partial pressure of water in the atmospheric air is beyond 1,000 Pa, an equilibrium water vapor pressure in the cabinet can be maintained at lower than 1,000 Pa, so that saturation of the porous carbon material with water by adsorbing moisture can be suppressed.

As a result, sufficient effects for the gas adsorption and desorption are obtained by the porous carbon material during the operation of the speaker unit, so that the ability to reproduce the bass range can be sufficiently exhibited. In addition, the sheet-like moisture adsorbent only requires smaller space volume for the installation in the application for the acoustic speaker device, the sound quality of the bass range can be improved for the small-sized acoustic speaker device.

In the acoustic speaker device of the aforementioned configuration, the quantity of the blended Cu-ZSM-5 zeolite over the aforementioned thermoplastic resin component may be equal to or smaller than 40 parts by weight. This can provide an appropriate blending quantity of the Cu-ZSM-5 zeolite over the quantity of the thermoplastic resin component, so that no crack or cleavage is generated in the obtained sheet-like moisture adsorbent, and also, the thickness can be reduced to the range of 1 to 10 μm while achieving sufficient strength.

Alternatively, in the acoustic speaker device of the aforementioned configuration, the aforementioned sheet-shaped gas adsorbent may be formed by a thermal forming, and the thermoplastic resin temperature in the thermal forming may be higher by 60 degrees C. than a softening temperature of the aforementioned thermoplastic resin. This can easily produce the sheet-like moisture adsorbent having sufficient strength, the thickness of which can be reduced to the range of 1 to 10 μm without generating a crack or tear.

Alternatively, in the acoustic speaker device of the aforementioned configuration, the Cu-ZSM-5 zeolite may be previously subjected to a thermal drying treatment before the forming. This can eliminate the moisture that has been previously contained in the Cu-ZSM-5 zeolite, so that further large volume of the moisture can be adsorbed at an ambient temperature and a low partial pressure.

Alternatively, in the acoustic speaker device of the aforementioned configuration, the Cu-ZSM-5 zeolite may be subjected to a vacuum thermal treatment before the forming. This can eliminate the moisture that has been previously contained in the Cu-ZSM-5 zeolite to improve ability for adsorbing moisture, and also cause reduction of $Cu2^{+}$ contained in the Cu-ZSM-5 zeolite into $Cu^{+}$. Hence, the sheet-shaped gas adsorbent can exhibit higher adsorbing activity to improve its moisture adsorbing function.

Alternatively, in the acoustic speaker device of the aforementioned configuration, the sheet-like moisture adsorbent may be stuck on an inner wall of the cabinet. This can reduce the space volume required for installing the sheet-like moisture adsorbent, so that further downsizing of the acoustic speaker device can be achieved.

EXAMPLES

More specific descriptions of the present invention will be made below in reference to Examples, Comparative Examples and Reference Examples, though it is not intended to limit the scope of the present invention. Various changes, modifications and alterations of the present invention will become apparent to a person having ordinary skills in the art without departing from the scope and the spirit of the present invention.

Here, evaluations of the physical properties of the sheet-like moisture adsorbing material 14B and evaluations of the ability to reproduce the bass range in the acoustic speaker device 10 in the following Example were conducted as follows.

[Method for Evaluating Appearance of Sheet-Like Moisture Adsorbing Material]

A presence of a problem that can be confirmed on the appearance such as a crack, a tear or a discoloration and the like in the sheet was evaluated by visual inspection for sheet-like moisture adsorbing materials 14B obtained in respective Examples and Comparative Examples.

[Method for Evaluating Adsorption-Start Water Vapor Pressure of Sheet-Like Moisture Adsorbing Material]

Water adsorption isotherm at 25 degrees C. was measured for sheet-like moisture adsorbing materials 14B obtained in each of Examples and Comparative Examples by employing trade name: Autosorb 1-C (commercially available from Quantachrome Instruments Inc.), and an adsorption-start water vapor pressure was derived as an equilibrium pressure, at which an absorbed amount of equal to or higher than 0.1 ml/g was measured. In addition to above, method for measuring the water adsorption isotherm will be simply described as follows.

First of all, weight of a sheet-like moisture adsorbing material 14B employed in the evaluation was weighed, and sample was inserted in a sample tube of a known volume. Next, the sample tube was connected to a manifold of a known volume through an open-shut section (stopcock).

Then, the temperature was adjusted so that the temperatures of the manifold and the sample tube were the measuring temperature. Since the measuring temperature was set to 25 degrees C. in the present embodiment, the manifold was disposed in a thermostatic chamber, and the sample tube was disposed in a constant temperature water tank to control the temperature to be constant. Next, on the condition that the open-shut section was opened, the insides of the manifold and the sample tube were evacuated to achieve vacuum. Thereafter, the open-shut section was closed to introduce a predetermined quantity of a gas (water vapor) into the manifold.

In addition to above, the amount of supply of the gas to the manifold was suitably defined so that a predetermined pressure was achieved when the open-shut section was opened after the above-described operation was conducted on the condition that no sample was present in the sample tube. For example, as will be discussed later, when the absorbed amount at 10 Pa was to be measured, a gas was introduced in the manifold until the pressure was slightly larger than 10 Pa, on the basis of volumes of the manifold and the sample tube.

The open-shut section in the above-described closed condition was opened to introduce a gas (water vapor) from the manifold to the sample tube, and after a predetermined time was passed, the pressure in the manifold was measured. The amount of the gas (water vapor) adsorbed on the sample was calculated from the pressure drop at this time, which was divided by the weight of the sheet-like moisture adsorbing material 14B which was previously measured to obtain an adsorption capacity per unit weight.

In addition to above, in the following Examples and Comparative Examples, amount of the gas adsorbed on the sample (adsorption capacity) will be provided by volume in the standard state of 25 degrees C. and 1 atmospheric-pressure.

[Method for Evaluating Tensile Strength of Sheet-Like Moisture Adsorbing Material]

Tensile strength was measured according to JIS K-7127 by employing trade name: Autograph (commercially available from Shimadzu Corporation) for sheet-like moisture adsorbing materials 14B obtained in respective Examples and Comparative Examples.

[Method for Evaluating Formable Sheet Thickness]

In respective Examples and Comparative Examples, when the sheet-like moisture adsorbing material 14B was formed, the forming was started on the condition that the sheet thickness was 300 μm at first, and the sheet thickness was gradually increased while confirming the occurrence of a crack or tear by visual inspection, and the sheet thickness shortly before a crack or tear was generated was defined as "formable sheet thickness." The measurement of the sheet thickness was carried out by employing trade name: Super Caliper (Mitsutoyo Corporation).

Meanwhile, the sheet formation was conducted for the thickness down to 10 μm in each of the following Examples and Comparative Examples, and therefore an Example, in which the evaluation result of 10 μm was obtained, can be considered that further reduction of the thickness may be possible.

[Method for Evaluating Ability to Reproduce Bass Range in Acoustic Speaker Device]

The acoustic speaker device 10 having the configuration described in Embodiment was employed, and the sheet-like moisture adsorbing materials 14B obtained in respective Examples and Comparative Examples were stuck on the floor surface and the ceiling surface in the cabinet 12. Then, the acoustic speaker device 10 was installed in an environment assuming summer climate, atmospheric temperature of 30 degrees C. and relative humidity of 70%, that is to say water vapor pressure of 2,970 Pa, and input of 1 W sine wave was added to measure sound pressure at a distance of 1 m from the acoustic speaker device 10. In addition to above, the acoustic pressure measurements were conducted for each of the conditions: right after the installation of the acoustic speaker device 10 in the aforementioned environment; and one day after the installation. In addition, the measured values of 20 dB and 50 dB after one day were provided as representative values of the bass range.

Figure 3:
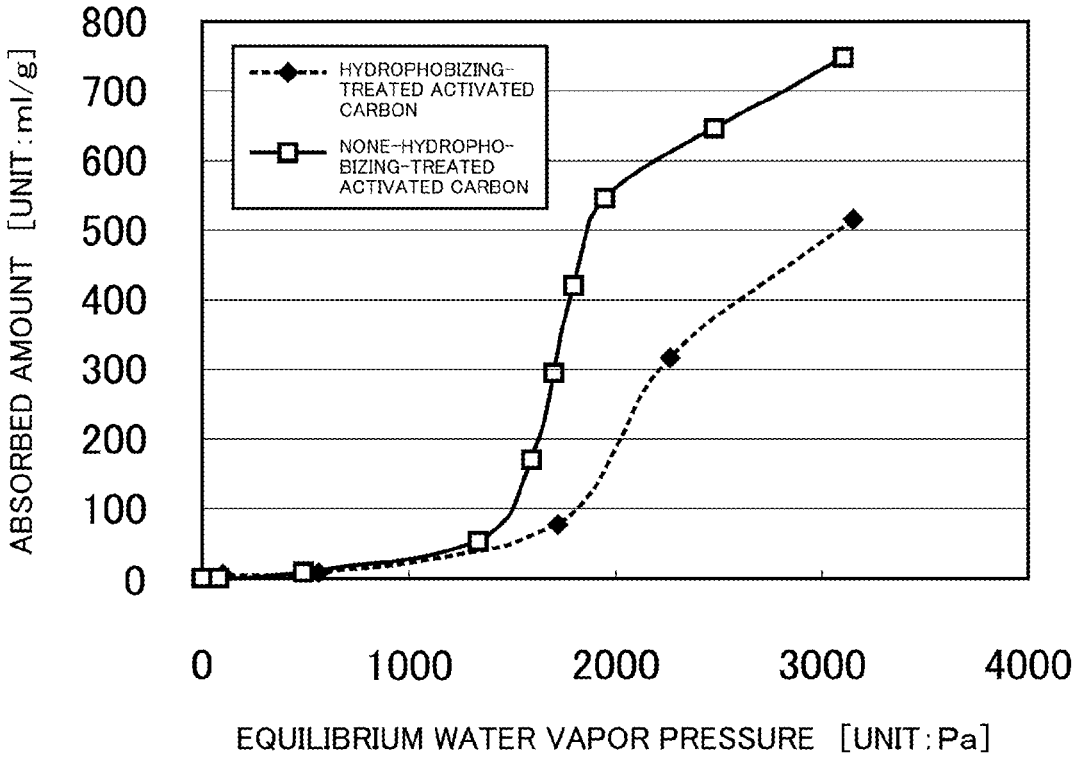
FIG. 3 is a graph, showing moisture adsorption isotherm for an activated carbon which a hydrophobizing treatment is made and an activated carbon which a hydrophobizing treatment is not made in a reference example of the present invention.
Figure 4:
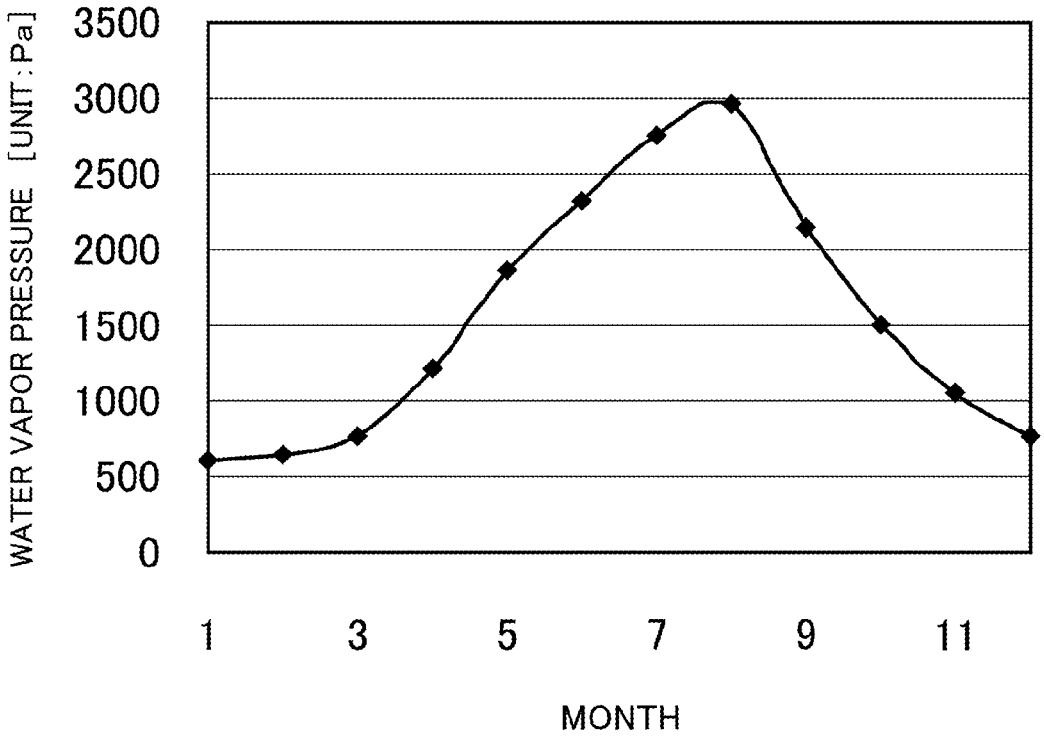
FIG. 4 is a graph, showing changes of water vapor pressure for one year in Osaka Japan.

Next, as described in the above-described Embodiment, Reference Example for verifying that the partial pressure of water in the atmospheric air was about 1,000 Pa in the general operating environment of the acoustic speaker device 10 will be specifically described in reference to FIG. 3 and FIG. 4.

Reference Example

Activated carbon was hydrophobized by using hexamethyldisiloxane serving as a hydrophobizing agent via a method according to Patent Document 3 to prepare "hydrophobizing-treated activated carbon." Then, water adsorption isotherms at 25 degrees C. were evaluated, in addition to the evaluation of original activated carbon which is not hydrophobized (none-hydrophobizing-treated activated carbon). The results thereof are shown in FIG. 3.

In addition to above, in the present Reference Example, the measurements of the adsorption isotherm were carried out by employing trade name: BELSORP-18 (BEL Japan, Inc.). More specifically, water (gas phase) was in contact with the respective surfaces of the none-hydrophobizing-treated activated carbon and the hydrophobizing-treated activated carbon from lower pressure, and amount of water reached to the adsorption equilibrium was quantified from a water vapor pressure corresponding to the start of the adsorption to about 3,169 Pa corresponding to saturated steam at 25 degrees C.

In FIG. 3, abscissa represents equilibrium water vapor pressure (unit: Pa) in adsorption of moisture and ordinate represents absorbed amount of a water (unit: ml/g). Also, adsorption isotherm of the none-hydrophobizing-treated activated carbon was provided by a solid line and symbols of white square, and adsorption isotherm of the hydrophobizing-treated activated carbon was represented by dotted line and symbols of black square.

As shown in FIG. 3, the none-hydrophobizing-treated activated carbon exhibited that the adsorption start pressure was 80 Pa, and the absorbed amount was rapidly increased from around the point that equilibrium water vapor pressure was beyond 1,000 Pa, and the absorbed amount near 3,169 Pa reached 750 ml/g.

On the other hand, the hydrophobizing-treated activated carbon exhibited that similarly as the none-hydrophobizing-treated activated carbon, the adsorption start pressure was 80 Pa, and the absorbed amount was rapidly increased from around the point that equilibrium water vapor pressure was beyond 1,500 Pa. Hence, it was clear that the tendency that the absorbed amount was rapidly increased as being beyond a predetermined equilibrium water vapor pressure was not changed regardless of the treatment for the hydrophobizing, and the hydrophobizing-treated activated carbon only showed reduced absorbed amount at equal to or higher than 1,000 Pa, as compared with the none-hydrophobizing-treated activated carbon.

Meanwhile, a threshold of the equilibrium water vapor pressure of 1,000 Pa will be described in reference to FIG. 4. FIG. 4 shows changes of water vapor pressure over twelve months: one year of Osaka-city, Japan, calculated from the average atmospheric temperature and the average relative humidity. As shown in FIG. 4, it is seen that water vapor pressure is equal to or higher than 1,000 Pa generally from April to November in Osaka-city. Consequently, it can be concluded that the condition of the water vapor pressure of 1,000 Pa, is a general environment for using the acoustic speaker device 10.

Hence, it is clarified that the fact that rapid moisture adsorption is caused around the point that the water vapor pressure is 1,000 Pa for both of the none-hydrophobizing-treated activated carbon and the hydrophobizing-treated activated carbon is a problem for the function of the activated carbon, which is capable of rapidly adsorbing and eliminating a gas compressed and expanded in the cabinet 12 in the ordinary operating environment.

Next, specific Example and Comparative Example of the sheet-like moisture adsorbing materials 14B according to the present invention and the acoustic speaker devices 10 employing thereof will be described.

Example 1

High density polyethylene (HDPE: softening temperature: 130 degrees C.) was employed as the thermoplastic resin composition 44. Also, the blending quantity of the Cu-ZSM-5 zeolite 43 was set to 40 parts by weight over the 100 parts by weight of high density polyethylene. In addition to above, vacuum thermal treatment at 600 degrees C. for four hours was conducted for Cu-ZSM-5 zeolite 43 in advance.

Next, sheet forming of these were conducted with an extruder to obtain the sheet-like moisture adsorbing material 14B of the present Example. In addition to above, the resin temperature in the sheet forming was set at 190 degrees C. that was the upper limit temperature.

Further, the acoustic speaker device 10, to which the obtained sheet-like moisture adsorbing material 14B was adopted, was produced according to the aforementioned embodiment. Porous carbon material 41 employed in this Example was activated carbon made of coconut shell as the raw material (coconut shell carbon), and this activated carbon was encapsulated in an all-side sealed bag of a nonwoven fabric having permeability to prepare the porous carbon material package unit 14A, and the prepared member was placed on the floor surface in the cabinet 12. Also, the obtained sheet-like moisture adsorbing material 14B was stuck on the floor surface and the ceiling surface of the cabinet 12.

Figure 5:
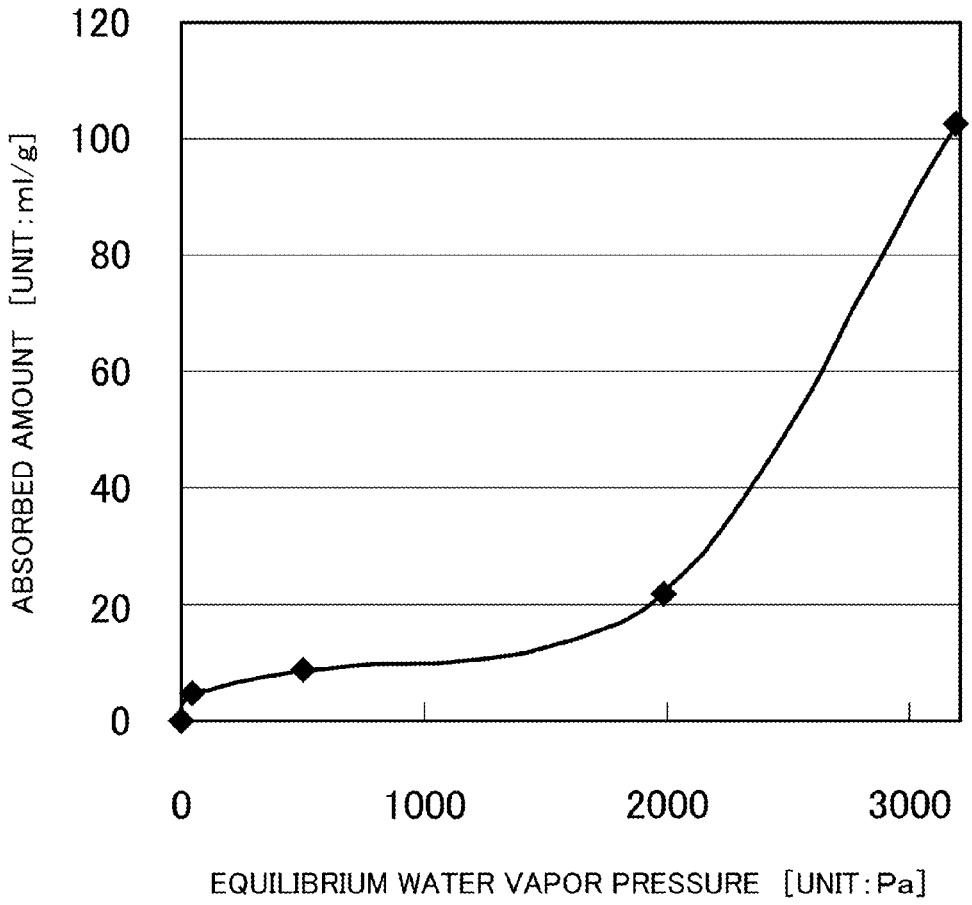
FIG. 5 is a graph, showing moisture adsorption isotherm in the sheet-like moisture adsorbing material employed in the acoustic speaker device of Example 1 of the present invention.

The production conditions and the evaluation results of the obtained sheet-like moisture adsorbing material 14B, and the evaluation results of the acoustic speaker device 10, to which the obtained sheet-like moisture adsorbing material 14B was adopted, are shown in Table 1. Also, the water adsorption isotherm at 25 degrees C. for the obtained sheet-like moisture adsorbing material 14B is shown in FIG. 5.

Example 2

A sheet-like moisture adsorbing material 14B of the present Example was obtained similarly as in the aforementioned Example 1 except that a thermal drying treatment at 200 degrees C. for four hours was preliminarily conducted for the Cu-ZSM-5 zeolite 43, and an acoustic speaker device 10, to which the sheet-like moisture adsorbing material 14B was adopted, was produced similarly as in the aforementioned Example 1.

The production conditions and the evaluation results of the obtained sheet-like moisture adsorbing material 14B, and the evaluation results of the acoustic speaker device 10, to which the obtained sheet-like moisture adsorbing material 14B was adopted, are shown in Table 1.

Example 3

A sheet-like moisture adsorbing material 14B of the present Example was obtained similarly as in the aforementioned Example 1 except that polypropylene (PP: softening temperature: 160 degrees C.) was employed as the thermoplastic resin composition 44 and the resin temperature in the sheet forming was set at 200 degrees C. that was lower than the upper limit temperature, and an acoustic speaker device 10, to which the sheet-like moisture adsorbing material 14B was adopted, was produced similarly as in the aforementioned Example 1.

The production conditions and the evaluation results of the obtained sheet-like moisture adsorbing material 14B, and the evaluation results of the acoustic speaker device 10, to which the obtained sheet-like moisture adsorbing material 14B was adopted, are shown in Table 1.

Example 4

A sheet-like moisture adsorbing material 14B of the present Example was obtained similarly as in the aforementioned Example 1 except that nylon (softening temperature: 225 degrees C.), was employed as the thermoplastic resin composition 44 and the resin temperature in the sheet forming was set at 250 degrees C. that was lower than the upper limit temperature, and an acoustic speaker device 10, to which the sheet-like moisture adsorbing material 14B was adopted, was produced similarly as in the aforementioned Example 1.

The production conditions and the evaluation results of the obtained sheet-like moisture adsorbing material 14B, and the evaluation results of the acoustic speaker device 10, to which the obtained sheet-like moisture adsorbing material 14B was adopted, are shown in Table 1.

TABLE 1

| | | EXAMPLES | | | |
|---|---|---|---|---|---|
| | | 1 | 2 | 3 | 4 |
| PRODUCTION CONDITIONS | THERMOPLASTIC RESINS | HDPE | HDPE | PP | Nylon |
| | SOFTENING TEMPERATURE [° C.] | 130 | 130 | 160 | 225 |
| | RESIN TEMPERATURE IN SHEET FORMING [° C.] | 190 | 190 | 200 | 250 |
| | TYPE OF ZEOLITE | Cu-ZSM-5 zeolite | Cu-ZSM-5 zeolite | Cu-ZSM-5 zeolite | Cu-ZSM-5 zeolite |
| | BLENDING RATIO OF ZEOLITE [parts by weight] | 40 | 40 | 40 | 40 |
| | PRETREATMENT OF ZEOLITE | VACUUM THERMAL TREAT-MENT | THERMAL DRYING TREAT-MENT | VACUUM THERMAL TREAT-MENT | VACUUM THERMAL TREAT-MENT |

TABLE 1-continued

| | | EXAMPLES | | | |
|---|---|---|---|---|---|
| | | 1 | 2 | 3 | 4 |
| EVALUATION RESULTS OF SHEET-LIKE GAS ADSORBING | APPEARANCE | GOOD | GOOD | GOOD | GOOD |
| | ADSORPTION-START WATER VAPOR PRESSURE [Pa] | 3 | 5 | 2 | 2 |
| | TENSILE STRENGTH [MPa] | 33.1 | 33 | 100 | 180 |
| | FORMABLE SHEET THICKNESS [μm] | 10 | 10 | 10 | 10 |
| EVALUATION RESULTS OF ACOUSTIC SPEAKER DEVIC | ACOUSTIC PRESSURE AT 20 Hz ONE DAY AFTER INSTALLATION [dB] | 54 | 53 | 55 | 55 |
| | ACOUSTIC PRESSURE AT 20 Hz ONE DAY AFTER INSTALLATION [dB] | 69 | 67 | 69 | 68 |

Example 5

A sheet-like moisture adsorbing material 14B of the present Example was obtained similarly as in the aforementioned Example 1 except that the blending quantity of the Cu-ZSM-5 zeolite 43 was set to 20 parts by weight and no pretreatment was conducted for the Cu-ZSM-5 zeolite 43, and an acoustic speaker device 10, to which the sheet-like moisture adsorbing material 14B was adopted, was produced similarly as in the aforementioned Example 1.

The production conditions and the evaluation results of the obtained sheet-like moisture adsorbing material 14B, and the evaluation results of the acoustic speaker device 10, to which the obtained sheet-like moisture adsorbing material 14B was adopted, are shown in Table 2.

Example 6

A sheet-like moisture adsorbing material 14B of the present Example was obtained similarly as in the aforementioned Example 5 except that the blending quantity of the Cu-ZSM-5 zeolite 43 was set to 40 parts by weight and an acoustic speaker device 10, to which the sheet-like moisture adsorbing material 14B was adopted, was produced similarly as in the aforementioned Example 5.

The production conditions and the evaluation results of the obtained sheet-like moisture adsorbing material 14B, and the evaluation results of the acoustic speaker device 10, to which the obtained sheet-like moisture adsorbing material 14B was adopted, are shown in Table 2.

Example 7

A sheet-like moisture adsorbing material 14B of the present Example was obtained similarly as in the aforementioned Example 5 except that the blending quantity of the Cu-ZSM-5 zeolite 43 was set to 42 parts by weight, and an acoustic speaker device 10, to which the sheet-like moisture adsorbing material 14B was adopted, was produced similarly as in the aforementioned Example 5.

The production conditions and the evaluation results of the obtained sheet-like moisture adsorbing material 14B, and the evaluation results of the acoustic speaker device 10, to which the obtained sheet-like moisture adsorbing material 14B was adopted, are shown in Table 2.

Example 8

A sheet-like moisture adsorbing material 14B of the present Example was obtained similarly as in the aforementioned Example 5 except that the resin temperature in the sheet forming was set to 200 degrees C. that was higher than the upper limit temperature, and an acoustic speaker device 10, to which the sheet-like moisture adsorbing material 14B was adopted, was produced similarly as in the aforementioned Example 5.

The production conditions and the evaluation results of the obtained sheet-like moisture adsorbing material 14B, and the evaluation results of the acoustic speaker device 10, to which the obtained sheet-like moisture adsorbing material 14B was adopted, are shown in Table 2.

Example 9

A sheet-like moisture adsorbing material 14B of the present Example was obtained similarly as in the aforementioned Example 5 except that the resin temperature in the sheet forming was set to 220 degrees C. that was higher than the upper limit temperature, and an acoustic speaker device 10, to which the sheet-like moisture adsorbing material 14B was adopted, was produced similarly as in the aforementioned Example 5.

The production conditions and the evaluation results of the obtained sheet-like moisture adsorbing material 14B, and the evaluation results of the acoustic speaker device 10, to which the obtained sheet-like moisture adsorbing material 14B was adopted, are shown in Table 2.

TABLE 2

| | | EXAMPLES | | | | |
|---|---|---|---|---|---|---|
| | | 5 | 6 | 7 | 8 | 9 |
| PRODUCTION CONDITIONS | THERMOPLASTIC RESINS | HDPE | HDPE | HDPE | HDPE | HDPE |
| | SOFTENING TEMPERATURE [° C.] | 130 | 130 | 130 | 130 | 130 |
| | RESIN TEMPERATURE IN SHEET FORMING [° C.] | 190 | 190 | 190 | 200 | 220 |

TABLE 2-continued

| | | EXAMPLES | | | | |
|---|---|---|---|---|---|---|
| | | 5 | 6 | 7 | 8 | 9 |
| | TYPE OF ZEOLITE | Cu-ZSM-5 zeolite | Cu-ZSM-5 zeolite | Cu-ZSM-5 zeolite | Cu-ZSM-5 zeolite | Cu-ZSM-5 zeolite |
| | BLENDING RATIO OF ZEOLITE [parts by weight] | 20 | 40 | 42 | 20 | 20 |
| | PRETREATMENT OF ZEOLITE | NONE | NONE | NONE | NONE | NONE |
| EVALUATION RESULTS OF SHEET-LIKE GAS ADSORBING | APPEARANCE | GOOD | GOOD | TEAR | DISCOLORATION | DISCOLORATION, CRACK |
| | ADSORPTION-START WATER VAPOR PRESSURE [Pa] | 10 | 10 | 15 | 12 | 18 |
| | TENSILE STRENGTH [MPa] | 30.2 | 32.2 | 30.8 | 50 | 34.5 |
| | FORMABLE SHEET THICKNESS [μm] | 10 | 10 | 123 | 150 | 180 |
| EVALUATION RESULTS OF ACOUSTIC SPEAKER DEVIC | ACOUSTIC PRESSURE AT 20 Hz ONE DAY AFTER INSTALLATION [dB] | 53 | 53 | 52 | 52 | 52 |
| | ACOUSTIC PRESSURE AT 20 Hz ONE DAY AFTER INSTALLATION [dB] | 67 | 67 | 66 | 67 | 66 |

Comparative Example 1

A comparative acoustic speaker device was produced similarly as in the aforementioned Example 1 but without applying the sheet-like moisture adsorbing material 14B and only employing the porous carbon material package unit 14A. Evaluation results of the comparative acoustic speaker devices are shown in Table 3.

Comparative Example 2

A comparative sheet-like moisture adsorbing material was obtained similarly as in the aforementioned Example 1 except that a copper ion-exchanged X-type zeolite (hereinafter abbreviated as "Cu—X zeolite" for the purpose of the convenience in the description) was employed in place of the Cu-ZSM-5 zeolite 43 and the blending quantity of the Cu—X zeolite was set to 20 parts by weight, and a comparative speaker device, to which the comparative sheet-like moisture adsorbing material was adopted, was produced similarly as in the aforementioned Example 1.

Here, the Cu—X zeolite is produced by conducting the copper ion-exchange for X-type zeolite, which is a general-purpose zeolite utilized as a moisture adsorbent, similarly as the Cu-ZSM-5 zeolite 43.

The production conditions and the evaluation results of the obtained comparative sheet-like moisture adsorbing material, and the evaluation results of the comparative acoustic speaker device, to which the obtained comparative sheet-like moisture adsorbing material was adopted, are shown in Table 3.

Comparative Example 3

A comparative sheet-like moisture adsorbing material was obtained similarly as in the aforementioned Comparative Example 2 except that the blending quantity of the Cu—X zeolite was set to 40 parts by weight, and a comparative acoustic speaker device, to which the comparative sheet-like moisture adsorbing material was adopted, was produced similarly as in the aforementioned Comparative Example 2.

The production conditions and the evaluation results of the obtained comparative sheet-like moisture adsorbing material, and the evaluation results of the comparative acoustic speaker device, to which the obtained comparative sheet-like moisture adsorbing material was adopted, are shown in Table 3.

TABLE 3

| | | COMPARATIVE EXAMPLES | | |
|---|---|---|---|---|
| | | 1 | 2 | 3 |
| PRODUCTION CONDITIONS | THERMOPLASTIC RESINS | — | HDPE | HDPE |
| | SOFTENING TEMPERATURE [° C.] | — | 130 | 130 |
| | RESIN TEMPERATURE IN SHEET FORMING [° C.] | — | 190 | 190 |
| | TYPE OF ZEOLITE | — | Cu-X zeolite | Cu-X zeolite |
| | BLENDING RATIO OF ZEOLITE [parts by weight] | — | 20 | 40 |
| | PRETREATMENT OF ZEOLITE | — | VACUUM THERMAL TREAT-MENT | VACUUM THERMAL TREAT-MENT |

TABLE 3-continued

| | | COMPARATIVE EXAMPLES | | |
|---|---|---|---|---|
| | | 1 | 2 | 3 |
| EVALUATION RESULTS OF SHEET-LIKE GAS ADSORBING | APPEARANCE | — | GOOD | GOOD |
| | ADSORPTION-START WATER VAPOR PRESSURE [Pa] | — | 200 | 180 |
| | TENSILE STRENGTH [MPa] | — | 29 | 28.4 |
| | FORMABLE SHEET THICKNESS [μm] | — | 10 | 10 |
| EVALUATION RESULTS OF ACOUSTIC SPEAKER DEVIC | ACOUSTIC PRESSURE AT 20 Hz ONE DAY AFTER INSTALLATION [dB] | 50 | 50 | 50 |
| | ACOUSTIC PRESSURE AT 20 Hz ONE DAY AFTER INSTALLATION [dB] | 64 | 64 | 64 |

[Evaluation Results]

(1) Results of Appearance Evaluation for Sheet-like Moisture Adsorbing Material In Examples 1 to 6, none of a crack or a tear and the like was generated and no discoloration was found in the obtained sheet-like moisture adsorbing material 14B. It is estimated that this is because the lending quantity of Cu-ZSM-5 zeolite 43 was equal to or lower than 40 parts by weight.

On the contrary, in Example 7, a generation of a tear was confirmed in a section of the obtained sheet-like moisture adsorbing material 14B. It is estimated that this is because the blending quantity of Cu-ZSM-5 zeolite 43 was larger than 40 parts by weight.

Also, a discoloration of dark brown was confirmed in the obtained sheet-like moisture adsorbing material 14B in Example 8, and a discoloration of strong tea brown and a crack was confirmed in the obtained sheet-like moisture adsorbing material 14B in Example 9. It is estimated that this is because the resin temperature in the sheet forming was beyond the upper limit temperature to cause copper corrosion in the thermoplastic resin, and it is particularly estimated in Example 9 that the resin temperature in the sheet forming, which was higher than in Example 8, induced more strong copper corrosion generated in the thermoplastic resin to generate a strong discoloration and a crack.

(2) Evaluation Result of Adsorption-Start Water Vapor Pressure of Sheet-Like Moisture Adsorbing Material The adsorption-start water vapor pressures in Examples 1 to 9 were considerably lower, as compared with Comparative Example 2 or 3 (Cu—X zeolite is employed instead of Cu-ZSM-5 zeolite 43). Consequently, it was clarified that the sheet-like moisture adsorbing materials 14B obtained in these Examples exhibited higher moisture adsorption activity.

Also, concerning the sheet-like moisture adsorbing material 14B obtained in Example 1, water adsorption isotherm at 25 degrees C. was evaluated. The results are shown in FIG. 5. As shown in FIG. 5, it can be seen that adsorption of moisture, which was not confirmed in the none-hydrophobizing treated activated carbon and the hydrophobizing-treated activated carbon in Reference Example, was generated in the region of the water vapor pressure of equal to or lower than 1,000 Pa in the sheet-like moisture adsorbing material 14B of Example 1.

Meanwhile, the adsorption-start water vapor pressure was considerably low in each of Examples 1, 4 and 3, as compared with Example 2 (thermal treatment was conducted in Cu-ZSM-5 zeolite 43 as pretreatment) and Example 6 (pretreatment is not conducted in Cu-ZSM-5 zeolite 43). Hence, it can be understood that the moisture adsorption activity is higher in the sheet-like moisture adsorbing materials 14B obtained in these Examples. It is estimated that moisture was eliminated and copper ion contained in the Cu-ZSM-5 zeolite 43 was activated by previously conducting the vacuum thermal treatment on the Cu-ZSM-5 zeolite 43 to exhibit higher moisture adsorption activity.

The adsorption-start water vapor pressure in Example 2 was moderately higher than in Example 1, and it is estimated that this is because copper ion contained in the Cu-ZSM-5 zeolite 43 cannot be sufficiently activated, since the pretreatment was not vacuum thermal treatment but the thermal treatment at 200 degrees C. for four hours. However, it is also estimated that the adsorption-start water vapor pressure in Example 2, which was lower as compared with that of Example 6 involving no preprocess, causes elimination of moisture which was previously contained in the Cu-ZSM-5 zeolite 43 by the thermal treatment at 200 degrees C. for four hours, so that moisture adsorption from regions of lower pressure was allowed.

Also, the adsorption-start water vapor pressure in each of Examples 5 to 9 was moderately higher than in Examples 1 to 4, and it is estimated that this is because no pretreatment was conducted to the Cu-ZSM-5 zeolite 43 to cause no elimination of moisture previously contained therein or no activation of copper ion. However, it can also be understood that moisture was partly eliminated from the Cu-ZSM-5 zeolite 43 by the heating in the forming step, so that the moisture adsorption activity was developed from the region of relatively lower pressure.

On the contrary, the comparative sheet-like moisture adsorbing materials in Comparative Examples 2 and 3 exhibited considerably higher adsorption-start water vapor pressure, as compared with Examples 1 to 9. It is estimated that this is because the Cu—X zeolite was employed instead of the Cu-ZSM-5 zeolite 43.

Also, since the comparative sheet-like moisture adsorbing materials in Comparative Examples 2 and 3 did not have sufficient moisture-adsorbing ability, the coconut shell carbon composing the porous carbon material 41 started its adsorption of moisture from the water vapor pressure of 100 Pa, both the comparative sheet-like moisture adsorbing material and the coconut shell carbon adsorbed moisture from the point near 200 Pa in Comparative Example 2 and from the point near 180 Pa in Comparative Example 3. Further, the coconut shell carbon rapidly adsorbed larger quantity of moisture when the water vapor pressure was beyond 1000 Pa, and it reached the condition at 2000 Pa, in which sufficient adsorption and elimination of the gas in the cabinet 12 were impossible.

While no comparative sheet-like moisture adsorbing material was employed in Comparative Example 1, the coconut shell carbon which was the porous carbon material 41 of this case start the adsorption of moisture from the water vapor pressure of 100 Pa, and larger quantity of moisture was rapidly adsorbed when it was beyond 1,000 Pa, about 80% of the micropores were in the condition of saturated adsorption by the water molecule-adsorption at 2,000 Pa. More specifically, it was clarified that larger quantity of moisture adsorption was caused when the water vapor pressure is beyond 1,000 Pa in Comparative Example 1, similarly as in Comparative Examples 2 and 3, which employed the comparative sheet-like moisture adsorbing material.

Consequently, it is estimated that there was no significant difference in terms of the advantageous effect for suppressing moisture adsorption of the porous carbon material 41 in Comparative Examples, regardless of the use of the sheet-like moisture adsorbing material. Hence, it is estimated that the use of the Cu—X zeolite is not sufficient to serve as the zeolite employed in the sheet-like moisture adsorbing material, and it is critical to be the Cu-ZSM-5 zeolite 43 as in the present invention.

(3) Tensile Strength of Sheet-Like Moisture Adsorbing Material and Evaluation Result of Sheet Thickness The sheet-like moisture adsorbing materials 14B obtained in Examples 1 to 6 exhibited enhanced tensile strengths, and the sheet thicknesses were able to be reduced down to 10 μm, which was the evaluation limit. It is estimated that this is because the resin temperature in the sheet forming was equal to or lower than the upper limit temperature, which was able to suppress copper corrosion of the thermoplastic resin by copper ion contained in the Cu-ZSM-5 zeolite 43.

On the contrary, the sheet-like moisture adsorbing material 14B obtained in Example 7, which exhibited the tensile strength that was equivalent to Examples 5 and 6, had larger sheet thickness, as compared with Example 5 or 6 (equivalent production conditions except the blending quantity of the Cu-ZSM-5 zeolite 43). It is estimated that this is because the blending quantity of Cu-ZSM-5 zeolite 43 was larger than 40 parts by weight. However, it is also estimated that generation of a tear, a crack or a discoloration resulted from the copper corrosion was suppressed since the resin temperature in the sheet forming was equal to or lower than the upper limit temperature.

In addition to above, it is also estimated that Example 7 exhibited the tensile strength that was equivalent to Example 5 or 6 though the thickness thereof was increased because the blending quantity of the Cu-ZSM-5 zeolite 43 was beyond 40 parts by weight to cause a tear, which reduced relative resin strength.

Also, even in the sheet-like moisture adsorbing materials 14B obtained in Examples 8 and 9, the sheet thicknesses thereof were increased until it was beyond Example 7 though the tensile strengths thereof were equivalent to Examples 5 and 6. It is estimated that this is because the resin temperature in the sheet forming was beyond the upper limit temperature, causing copper corrosion to generate embrittlement of the thermoplastic resin. It is also estimated that, particularly in Example 9, the resin temperature was higher than Example 8 to cause increased thickness as compared with Example 8.

In addition to above, it is also estimated that the sheet thicknesses of Examples 8 and 9 were increased though the tensile strengths thereof were equivalent to Examples 5 and 6 because the increase in the tensile strength was small and the relative resin strength was deteriorated by the copper corrosion.

(4) Evaluation Result of Ability to Reproduce Bass Range in Acoustic Speaker Device In all of the acoustic speaker devices 10 of Examples 1 to 9, higher acoustic pressures at 20 Hz and 50 Hz one day after the installation were obtained as compared with Comparative Examples 1 to 3. It is estimated that this is because the sheet-like moisture adsorbing material 14B was able to preferentially adsorb moisture so that air in the cabinet 12 was able to be sufficiently adsorbed or eliminated by the porous carbon material package unit 14A.

On the contrary, in the comparative acoustic speaker device of Comparative Example 1, measured values of the acoustic pressure at 20 Hz and 50 Hz were lower as compared with Examples 1 to 9. It is estimated that this is because about 80% of the micro pores in the coconut shell carbon serving as the porous carbon material 41 were adsorbing-saturated with water by water molecule adsorption at 2,000 Pa as described above, leading to the situation that the air in the cabinet 12 was able to be sufficiently adsorbed or eliminated.

Figure 6:
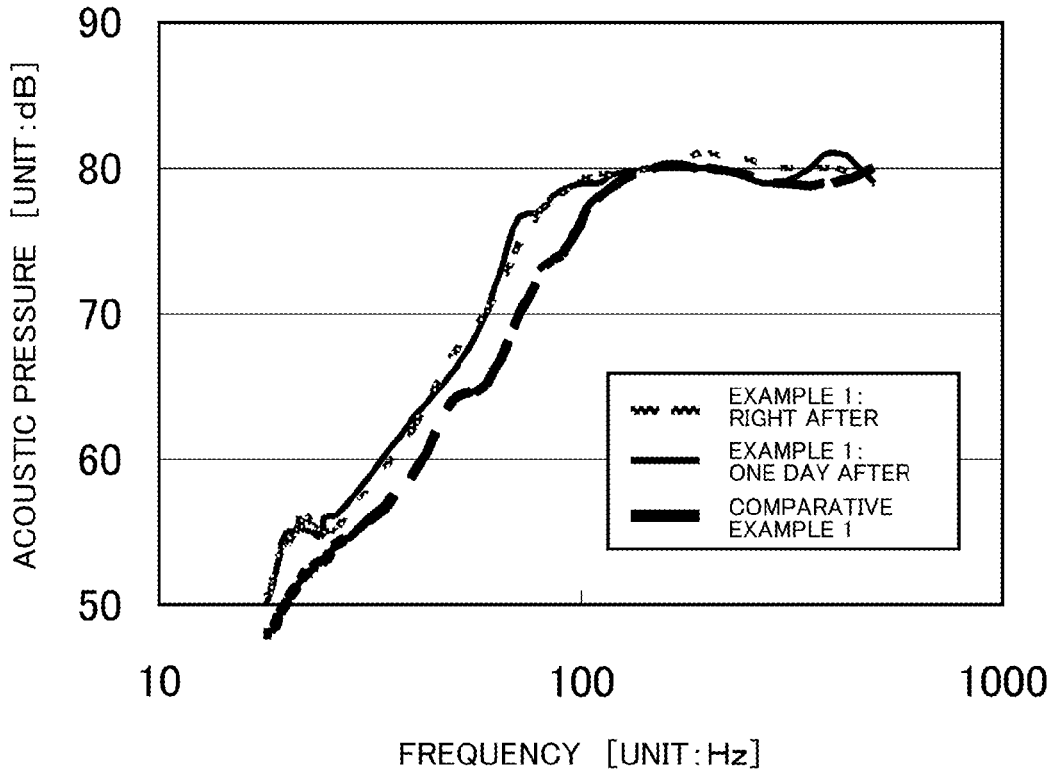
FIG. 6 is a graph, showing results of measurements in sound pressure in the acoustic speaker device of Example 1 of the present invention and a comparative acoustic speaker device of Comparative Example 1.

Meanwhile, evaluation results of acoustic pressure measurements in the bass range for the acoustic speaker device 10 of Example 1 and the comparative acoustic speaker device of Comparative Example 1 are shown in FIG. 6. In FIG. 6, meshed broken line represents the acoustic pressure measured right after that the acoustic speaker device 10 of Example 1 was installed in the measurement environment, solid line represents the acoustic pressure measured one day after that the acoustic speaker device 10 of Example 1 was installed in the measurement environment, and thick line represents the acoustic pressure measured by the comparative acoustic speaker device of Comparative Example 1 in the diagram. On the other hand, since Comparative Example 1 was configured to have no sheet-like moisture adsorbing material 14B, the measurement of acoustic pressure for right after or after one day from the installation was not conducted.

As is clear from the results shown in FIG. 6, it was found that the acoustic speaker device 10 provided with the sheet-like moisture adsorbing material 14B obtained in Example 1 exhibited enhanced sound pressure level in the low frequency region of 30 to 100 Hz, as compared with the comparative acoustic speaker device of Comparative Example 1, in which only porous carbon material package unit 14A was installed. Also, in the acoustic speaker device 10 of Example 1, substantially no change was found between right after the installation and one day after the installation.

Further, in the comparative acoustic speaker devices of Comparative Examples 2 and 3, measured values of the acoustic pressure at 20 Hz and 50 Hz were equivalent to Comparative Example 1 and were lower as compared with Examples 1 to 9. It is estimated that this caused that the comparative sheet-like moisture adsorbing material was not able to sufficiently adsorb the moisture in the cabinet 12.

In addition to above, a tear was generated in the sheet-like moisture adsorbing material 14B employed in Example 7, and a discoloration was generated and the thickness was increased in the sheet-like moisture adsorbing material 14B employed in Example 8 or 9. While the abnormalities generated in these sheets would not prevent the ability to reproduce the bass range in the acoustic speaker device 10, these may cause a situation that these are not preferable on the appearance and may also cause deteriorated handling ability, which may possibly lead to, for example, adversely affecting the sticking operation in the inside of the cabinet 12.

Hence, it is clarified that the blending quantity of Cu-ZSM-5 zeolite 43 in sheet-like moisture adsorbing material 14B is preferably set to equal to or lower than 40 parts by weight in the present invention, and the resin temperature in the sheet forming is preferably equal to or lower than the upper limit temperature (a temperature 60 degrees higher than the softening temperature of the thermoplastic resin).

It is apparent from the above-described descriptions that many modifications and other embodiments of the present invention may be possible for a person having ordinary skills in the art. Therefore, the above-described description should be construed only as an illustration, and is provided for the purpose of providing the best made of the present invention for a person having ordinary skills in the art. The detailed structure and/or function thereof may be substantially changed without departing from the scope and the spirit of the present invention.

INDUSTRIAL APPLICABILITY

The present invention can sufficiently achieve the adsorption and the elimination of the gas by the porous carbon material in the cabinet during the operation of the acoustic speaker device even in the high humid environment, and therefore the ability to reproduce the bass range can be effectively exhibited. Hence, the present invention can preferably employed for the improvement in the sound quality of the bass range in the entire fields of the acoustic speaker devices, regardless of the type of the device such as closed type or bass reflex types.

REFERENCE SIGNS LIST

10 acoustic speaker device
11 front face
12 cabinet
13 speaker unit
14A porous carbon material package unit
14B sheet-like moisture adsorbing material
41 porous carbon material
42 bag member
43 copper ion-exchanged ZSM-5 zeolite (Cu-ZSM-5 zeolite)
44 thermoplastic resin composition

The invention claimed is:

1. An acoustic speaker device, comprising:
a cabinet;
a speaker unit mounted on the cabinet; and
a gas adsorption material provided inside of the cabinet and being capable of adsorbing moisture and a gas component in the cabinet;
wherein the gas adsorption material is composed of at least a porous carbon material and a sheet-like moisture adsorbing material,
wherein the sheet-like moisture adsorbing material is formed by dispersing copper ion-exchanged ZSM-5 zeolite in a base material composed of at least a polymer material, and is stuck on at least a section of an inner wall of the cabinet,
wherein the base material of the sheet-like moisture adsorbing material is a resin composition containing a thermoplastic resin as the polymer material, and
wherein the sheet-like moisture adsorbing material is formed by blending equal to or less than 40 parts by weight of the ZSM-5 zeolite in 100 parts by weight of the resin composition and then thermally forming the blended material into a sheet form.

2. The acoustic speaker device according to claim 1, wherein the sheet-like moisture adsorbing material is stuck on at least an inner surface of the cabinet corresponding to a front side of the cabinet.

3. The acoustic speaker device according to claim 1, wherein the sheet-like moisture adsorbing material is stuck on at least a section of an inner surface of the cabinet right under the porous carbon material.

4. An acoustic speaker device comprising:
a cabinet;
a speaker unit mounted on the cabinet; and
a gas adsorption material provided inside of the cabinet and being capable of adsorbing moisture and a gas component in the cabinet;
wherein the gas adsorption material is composed of at least a porous carbon material and a sheet-like moisture adsorbing material,
wherein the sheet-like moisture adsorbing material is formed by dispersing copper ion-exchanged ZSM-5 zeolite in a base material composed of at least a polymer material, and is stuck on at least a section of an inner wall of the cabinet,
wherein the base material of the sheet-like moisture adsorbing material is a resin composition containing a thermoplastic resin as the polymer material, and
wherein the sheet-like moisture adsorbing material is thermally formed at a temperature equal to or lower than an upper limit temperature, which is higher by 60 degrees C. than a softening temperature of the thermoplastic resin.

5. The acoustic speaker device according to claim 4, wherein the sheet-like moisture adsorbing material is stuck on at least an inner surface of the cabinet corresponding to a front side thereof.

6. The acoustic speaker device according to claim 4, wherein the sheet-like moisture adsorbing material is stuck on at least a section of an inner surface of the cabinet right under the porous carbon material.

* * * * *